United States Patent [19]

Malewicz

[11] Patent Number: 5,068,956

[45] Date of Patent: Dec. 3, 1991

[54] IN-LINE ROLLER SKATE FASTENING SYSTEM AND METHOD OF ASSEMBLING THE SAME

[75] Inventor: Andrzej M. Malewicz, Minnetonka, Minn.

[73] Assignee: Rollerblade, Minnetonka, Minn.

[21] Appl. No.: 547,236

[22] Filed: Jul. 3, 1990

[51] Int. Cl.[5] ..... B23P 11/00; A63C 17/06

[52] U.S. Cl. ..... 29/437; 29/436; 29/453; 29/521; 29/525.1; 280/11.27; 411/372; 411/431

[58] Field of Search ..... 29/436, 437, 453, 521, 29/525.1, 525.2; 180/180; 272/70; 280/841, 11.2, 11.22, 11.27; 411/372, 373, 377, 431, 910

[56] References Cited

U.S. PATENT DOCUMENTS

| | | | |
|---|---|---|---|
| 1,805,937 | 12/1926 | Berge | 411/372 |
| 1,936,624 | 10/1931 | Gelpcke | 411/372 |
| 2,933,006 | 4/1960 | Gibb | 411/373 |
| 3,881,391 | 5/1975 | Dereszynski | 411/373 X |
| 3,930,432 | 1/1976 | Puchy | 411/376 |
| 4,129,060 | 12/1978 | Gould | 411/371 |
| 4,136.598 | 1/1979 | Hughes | 411/372 |
| 4,394,096 | 7/1983 | Stevens | 411/910 X |
| 4,413,374 | 11/1983 | Ferdinand et al. | 411/373 X |
| 4,601,624 | 7/1986 | Hill | 411/431 X |
| 4,894,902 | 1/1990 | Tucker | 29/437 |
| 4,909,523 | 3/1990 | Olson | 280/11.2 |

FOREIGN PATENT DOCUMENTS

| | | | |
|---|---|---|---|
| 2242870 | 3/1974 | Fed. Rep. of Germany . | |
| 1211068 | 10/1958 | France . | |
| 1281713 | 2/1961 | France . | |
| 1296753 | 5/1961 | France . | |
| 608864 | 9/1960 | Italy . | |
| 374858 | 11/1959 | Switzerland . | |
| 890049 | 2/1962 | United Kingdom . | |
| 916941 | 1/1963 | United Kingdom . | |
| 1116444 | 6/1968 | United Kingdom . | |
| 2082711 | 3/1982 | United Kingdom | 411/372 |

*Primary Examiner*—Joseph M. Gorski
*Assistant Examiner*—Peter Dungba Vo
*Attorney, Agent, or Firm*—Moore & Hansen

[57] ABSTRACT

Disclosed is an improved fastening system for attaching a wheel to the frame of an in-line roller skate. The system includes a fastening plug insertable into the axis aperture in the side rail of an in-line roller skate frame. The system further includes a snap cover assembly including an anchor insertable into the axle aperture of the side rail from the other side thereof, a nut insertable into a receptacle disposed in the anchor, and a snap cover for enclosing and covering the nut.

37 Claims, 1 Drawing Sheet

IN-LINE ROLLER SKATE FASTENING SYSTEM AND METHOD OF ASSEMBLING THE SAME

The present invention relates in general to fastener head cover assemblies and in particular to those types of assemblies useful on in-line roller skates.

BACKGROUND OF THE PRESENT INVENTION

In-line roller skates have a plurality of wheels mounted for rotation in a common plane on a frame that is attached to a boot. Initially, such skates were constructed using long, threaded end bolts to mount the wheels to the frame. The threaded ends of these bolts often extended substantially beyond the nut and presented a hazard to both other people and the outside environment in general. In particular, they were destructive to objects like furniture and to riding surfaces that were easily gouged or scratched. Wooden floors such as those found in skating rinks were particularly susceptible to damage by the axle bolts. As a result, many skating rinks banned the use of in-line roller skates because the owners thereof desired to protect the smooth finish of the floors from damage, thereby closing an important market to in-line roller skates.

Some improvements in the manner that the wheels are mounted to the frame have been made, including the use of a low profile round head bolt having a head configured to eliminate destructive scratching and that received an allen-type wrench. This improvement essentially solved one side of the axle problem. The other side with the nut, remained a problem. In an effort to at least partially solve the problem, the axle bolt was shortened so that it did not project significantly beyond the nut when the nut was tightened thereon. Under certain circumstances, the nut, however, would still gouge the floors.

Another problem with the current fastening systems is that two tools are required to assemble the wheels to the frame. First, an allen-wrench, screwdriver, hex head wrench or the like is needed for the head of the bolt, and, second, a box wrench or socket wrench or the like is needed for the nut that is tightened onto the threaded end of the axle bolt.

It would be desirable to have a fastening system to attach wheels to the frame of an in-line roller skate that would not be likely to mark or scratch floors, injure other persons, is aesthetically pleasing, and would make assembly of the wheels to the frame an easier task.

OBJECTS OF THE PRESENT INVENTION

It is a principle object of the present invention to provide new and improved apparatus that is not subject to the foregoing disadvantages.

It is another object of the present invention to provide a fastening system that is not likely to cause injury to persons or property.

It is a further object of the present invention to provide a fastening system for the wheels of an in-line roller skate that would be acceptable in roller-rinks.

It is yet a further object of the present invention to provide a fastening system of an in-line roller skate that enables an assembler to use only a single tool to attach a wheel to a frame.

It is still another object of the present invention to provide a fastening system for an in-line roller skate that is aesthetically pleasing.

SUMMARY OF THE PRESENT INVENTION

According to the present invention, there is provided an improved fastening system for attaching wheels to an in-line roller skate frame. The system includes a dual position spacer that is insertable into an appropriately configured frame axle aperture from the inside of the frame and that is capable of receiving in a spacer axle hole therein a threaded wheel axle having a head turnable with an allen-type wrench. The improved system further includes a dual position anchor made of a synthetic material that is insertable into the frame apertures from the outside of the frame, that is capable of receiving the threaded wheel axle in an anchor axle bore therein, and that has a receptacle configured to receive a nut and prevent it from rotating. The system further includes a threaded fastener for tightening on to the threaded axle and a snap cover for aesthetically enclosing the anchor and nut an protecting a riding surface and human flesh from abrasions, cuts and gouging. In a preferred embodiment, the anchor axle bore has a smaller diameter than the threaded axle. The system of the present invention can be assembled using a single allen-type wrench since the receptacle's configuration prevents the nut from turning as the axle is threaded into it.

The system of the present invention further contemplates a one piece snap cover assembly wherein the anchor, nut, and snap cover are assembled as a unit prior to inserting the anchor into the frame aperture, thereby further simplifying the fastening of the wheel to the skate frame. Preferably the anchor is an unthreaded base made of a synthetic material such as nylon that has threads cut into it by the threaded end of the wheel axle as it is screwed into the anchor.

DETAILED DESCRIPTION OF THE PRESENT INVENTION

Figure 1:
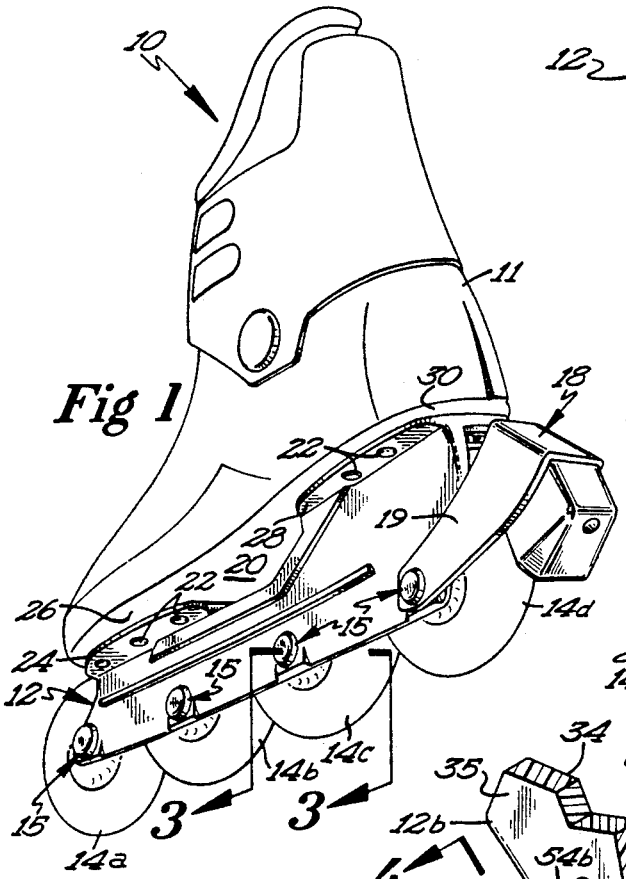
FIG. 1 is a perspective view of an in-line roller skate having a fastening system in accord with the present invention.

An in-line roller skate 10 in which the present invention may be embodied is shown in a perspective view in FIG. 1. Skate 10 includes a boot 11 attached to a frame 12 that rotatably supports a plurality of wheels, here 14*a*, 14*b*, 14*c*, and 14*d*. The wheels are attached to frame 12 by a fastening system 15 to be described in more detail with respect to FIGS. 2–6.

Frame 12 is attached to boot sole 20 by a sole bracket 24 that is attached by means of rivets 22 to fore sole 26 of boot 11 and by a heel bracket 28 that is attached by means of rivets 22 to a rear sole 30. Other means of attaching in-line roller skate frames to boots are known in the art and are equally useful with the present invention. In addition, while FIG. 1 shows four wheels attached to frame 12 it is well known in the art to use more or less than four wheels and thus a skate frame having any number of wheels is contemplated by the present invention.

Figure 3:
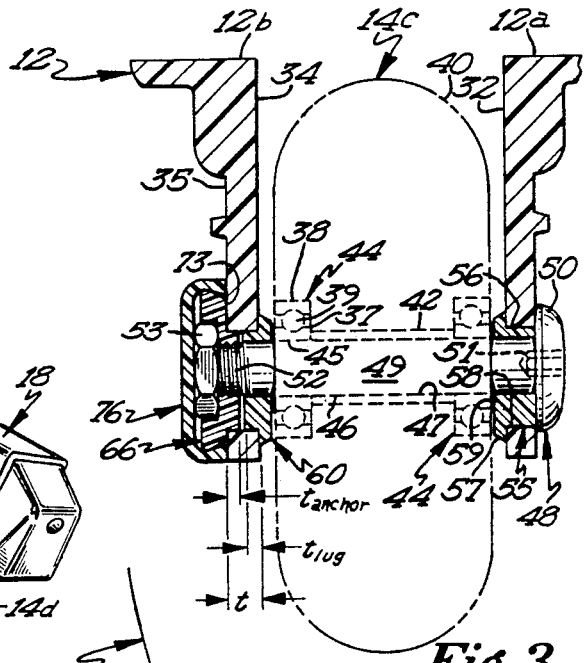
FIG. 3 is a cross sectional end view of a fastening system in accordance with the present invention taken along cutting plane 3—3 of FIG. 1.
Figure 2:
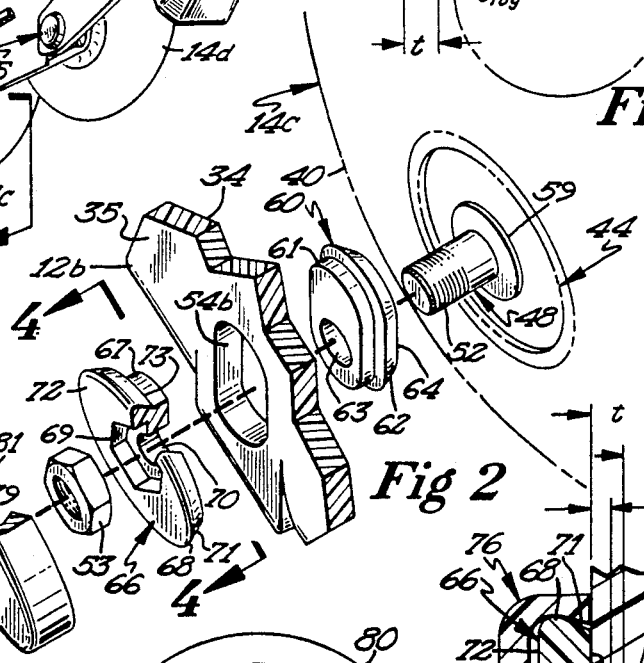
FIG. 2, is an exploded perspective view partially taken in phantom and partially in section and showing a fastening system that embodies the present invention

Referring now to FIGS. 2 and 3, wheel 14*c* comprises a tire 40 that is mounted on a hub 42 and that is rotatably supported by a pair of bearings 44 supported by a bearing sleeve 46. Bearing sleeve 46 includes a sleeve bore 47 through which an axle 48 passes as will be described in more detail later. In addition, each bearing 44 includes an inner race 37 and an outer race 38 rotatably supporting therebetween a plurality of rollers 39. Each bearing 44 further includes a bearing bore 45 for passage of axle 48. Wheel 14*c* is mounted between a first rail 12*a*, such as the inside rail of frame 12, and a second rail 12*b*, such as the outside rail of frame 12. As shown in FIG. 1, side rails 12*a* and 12*b* may each include a wing 19 of a brake assembly 18.

Referring again to FIG. 2 and 3, first rail 12*a* and second rail 12*b* each include an identically configured axle aperture 54*a* and 54*b* respectively. As shown in FIG. 2, axle apertures 54*a* and 54*b*, which are known to the prior art, have a substantially oval configuration to prevent rotation of the axle plugs and anchors to be hereafter described, but other configurations to prevent rotation are within the scope of and contemplated by the present invention.

Focusing on first rail 12*a*, an axle aperture plug 55 having a lug 56 is insertable into axle aperture 54*a* of rail 12*a*. Plug 55 further includes a collar 57 that bears against the inside surface 32 of rail 12&i a, a bore 58 through which axle 48 may be inserted, and an integral washer portion 59 that confronts a bearing 44. Axle 48 comprises a shaft 49 having a head 50 with an allen type fitting 51 disposed at one end thereof and a threaded end portion 52 at the other end and to which a nut 53 may be threadably attached.

Figure 6:
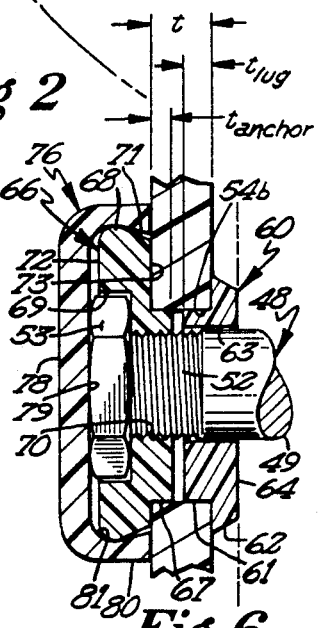
FIG. 6 illustrates in greater detail a cross sectional end view of the snap cover assembly of the present invention.
Figure 4:
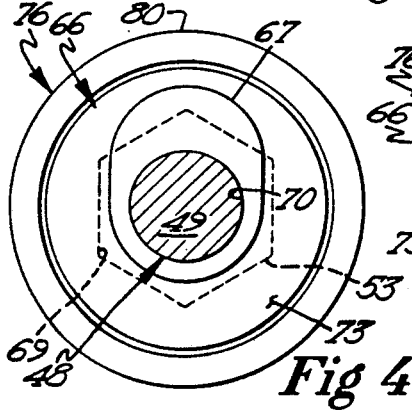
FIG. 4 is a partial cross sectional side view of a frame and anchor taken along cutting plane 4—4 of FIG. 3 and showing an embodiment of an anchor in a first operating position.

Referring to FIGS. 2, 3 and 6, the remainder of fastening system 15 will be described. Second rail 12*b* has a thickness t in the area through which axle 48 passes. Disposed between wheel 14*c* and the inside surface 34 of rail 12*b* is a fastening plug 60. Plug 60 includes a lug 61 that is insertable into axle aperture 54*b*, a collar 62 that bears against the inside surface 34 of rail 12*b*, an eccentrically disposed bore 63 that is configured to receive shaft 49 of axle 48, and a washer portion 64 that bears against bearing 44. Fastening plug 60 is identical to axle aperture plug 65 in all respect save one. As shown in FIG. 3, lug 56 of axle aperture plug 55 extends substantially all the way through side rail 12*a* while lug 61 of fastening plug 60 extends only partially through rail 12*b*. In other words, lug 56 of axle aperture plug 55 has a thickness substantially equal to thickness t of side rail 12*a* whereas lug 61 of fastening plug 60 has a thickness $t_{lug}$ that is less than the thickness t of side rails 12*b* and 12*a*. ? Further depicted in FIGS. 2 through 6 is an anchor 66 including an anchor lug 67 having a configuration substantially identical to lug 61 of fastening plug 60 but having a thickness $t_{anchor}$ that is less than $t_{lug}$. The sum of the thicknesses of lug 61 of fastening plug 60 and lug 67 of anchor 66 should not exceed the thickness t of side 12*b*. Since both fastening plug 60 and anchor 66 have lugs 61 and 67, respectively, configured for insertion into aperture 54*b*, both plug 60 and anchor 66 are non-rotatable with respect to frame rail 12*b*.

Anchor 66 further includes an anchor rim 68. Anchor rim 68 has a substantially circular configuration. Rim 68 has a substantially flat top surface 72 into which a receptacle 69 is disposed and also has a lower surface 73 that bears against rail 12*b*. Both upper surface 72 and lower surface 73 have a substantially concentric circular configuration such that the diameter of lower surface 73 is less than the diameter of upper surface 72. The two surfaces are connected by at least one side wall 71 which is inclined inwardly from upper surface 72 to lower surface 73.

Anchor 66 further includes an anchor bore 70. Anchor 66 may be made of a nylon type material and manufactured such that bore 70 is of a smaller diameter than the diameter of axle 49. This reduced diameter allows threaded end 52 of axle 48 to cut threads in the side of anchor bore 70 as axle 48 is threaded therethrough into a nut 53. Anchor 66 thus acts as a nut for threaded end 52.

Receptacle 69 has a substantially hexagonal configuration to receive a hexagonal nut 53 and to prevent nut 53 from rotating as axle bolt 48 is screwed therein. Receptacle 69 could equally well have other configurations as could nut 53 and such are contemplated within the scope of the present invention. Receptacle 69 should be configured however, such that it can hold nut 53 in a non-rotational manner.

The fastening system further includes a snap cover 76 that is yieldably snap fitted to anchor 66, thereby enclosing nut 53 and bolt end 52. Snap cover 76 has a generally shield-like configuration defined by a generally convex outer portion 78 and a generally concave inner portion 79. Snap cover 76 includes a snap cover rim 80 projecting peripherally downwardly from the outer portion 78. Snap cover rim 80 includes a snap groove 81 defined internally therein, which receives anchor rim 68 when attached to anchor 66. Snap groove 81 is configured to mate closely with anchor rim 68 and to removably retain snap cover 76 thereon. As shown snap groove 81 has a cross section substantially similar to a truncated triangle. Snap cover 76 is illustrated as having a solid configuration but could be configured to have an open center portion comprising an aperture therethrough. Snap cover 76 as described and shown thereby provides an aesthetically pleasing appearance that also functions to protect other skaters and the outside environment, including wooden skating surfaces, from injury due to bolt end 52 and nut 53.

Figure 5:
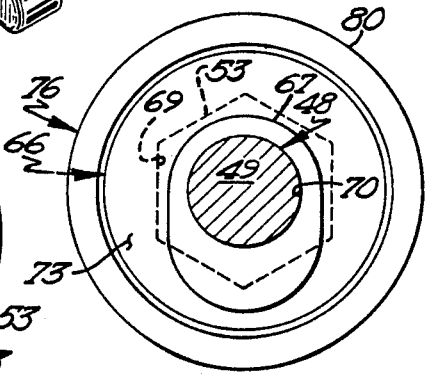
FIG. 5 is a partial cross sectional side view of the same structure as FIG. 4 wherein the anchor is in a second operating position.

As previously mentioned, bore 63 of plug 60 is eccentrically positioned and plug 60, therefore, is capable of two positions with respect to aperture 54*b*. Similarly, bore 70 of anchor 66 is eccentrically disposed with respect to lug 67 and thus anchor 66 is also capable of dual positions with respect to aperture 54*b*. As shown in greater detail in FIGS. 4 and 5, an anchor 66 is shown in respective first and second positions with respect to aperture 54*b*. Thus in FIG. 4 anchor 66 is positioned with respect to aperture 54*b* such that bore 70 of anchor 66 is disposed in the lower portion of aperture 54*b*. As shown in FIG. 5, anchor 66 is disposed such that bore 70 is disposed in the upper portion of aperture 54*b*. Comparison of the Figures shows how the eccentric disposition of bore 70 allows the wheel to be mounted with respect to frame 12 at different heights so that skaters may selectively mount the wheels on an in-line skate frame at desired height relationships.

When the present fastening system is to be used in relation to a wheel such as wheel 14*d*, whose axle supports brake assembly 18, a slight modification of the embodiment shown in the figures is necessary As noted previously, wings 19 of brake assembly 18 may form part of side rails 12*a* and 12*b*. Under such a circumstance, wing 19 would include an axle aperture configured to receive lug 67 of anchor 66. Side rail 12*b* would have an axle aperture plug 55 rather than a fastening plug 60 that would be received by aperture 54*b*. Thus, with respect to wheel 14*d*, an aperture plug 55 would be used in lieu of fastening plug 60. In all of the respects, the fastening system for wheel 14*d* would be identical to the fastening system described previously.

Having thus described the fastening system of the present invention, the method of attaching a wheel to a frame will now be described. Referring to FIGS. 2, 3, and 6 axle aperture plug 55 and fastening plug 60 are inserted within axle apertures 54*a* and 54*b*, respectively in the first rail 12*a*and second rail 12*b* respectively. Wheel 14*c* is then inserted between rails 12*a* and 12*b* such that bores 58 and 63 of aperture plug 55 and fastening plug 63 respectively are aligned with bore 47 of wheel 14. Nut 53 is inserted into receptacle 69 of anchor 66, which is inserted into aperture 54*b* of rail 12*b* from the outside surface 35 thereof in a direction opposite of that in which fastening plug 63 is inserted into aperture 54*b*. Anchor 66 may be inserted into aperture 54*b* either before or after wheel 14*c* is placed between rails 12*a* and 12*b* or before the plugs are inserted therein. Axle 48 is next inserted through bore 58 of aperture plug 55, bore 47 of wheel 14*c*, and bore 63 of fastening plug 60. Because anchor bore 70 has a smaller diameter than axle 48, axle 48 must now be threaded into and through bore 70. This is done by using an allen-type wrench attached to fitting 51 of head 50. As axle 48 is threaded into anchor 66 threads are cut into the bore 70. Anchor 66 thus acts as a locknut to retain axle 48 within frame 12 and to resist loosening during vibrations encountered during operation. Axle 48 is turned further into nut 53 for additional security. After axle 48 has been completely screwed into nut 53 snap cover 76 is snapped onto anchor 66.

With the present fastening system, only one tool, in this particular instance, an allen-type wrench, is needed to assemble an individual wheel to frame 12. While an allen-type bolt head is shown, other types of bolt heads and tools therefore, such as a slotted head bolt or a phillips head bolt and a slotted screwdriver or a phillips screwdriver respectively, are also contemplated by the present invention. Additionally, any other type of bolt head/tool combination that can be used to turn axle 48 is within the scope of the invention as set out herein.

While wheels 14 last for a considerable length of time, they can eventually become worn and need replacement. With the present invention, replacement or even initial installation of wheels can be considerably simplified. Thus, in the case of a replacement, axle 48 would be removed from frame 12 and wheel 14 would be removed and replaced by a new wheel. Because snap cover 76 is attached to anchor 66, snap cover 76, nut 53, and anchor 66 form a single unit that could be removed and then put back in place during the wheel replacement or could remain in place throughout the wheel replacement. In addition, if desired prior to an initial assembly of a frame and a wheel, nut 53 could be inserted into receptacle 69 and snap cover 76 attached thereto. The entire unit could then be inserted into aperture 54 and axle 48 screwed therein. In any event, the present fastening assembly simplifies the attachment of a wheel to a frame because only one tool is needed to do so. This simplifies the manufacture of an in-line roller skate, thereby reducing manufacturing costs.

While the present invention has been shown with the axle being inserted into frame 12 from the inside such that the snap cover 76 is disposed on the outside rail 12*b*, reversing the direction of assembly such that axle 48 is inserted from the outside rail 12*b* and snap cover 76 is disposed against inside rail 12*a* is also within the purview of the present invention. Furthermore, the present invention contemplates the development of stronger materials for anchor 66 such that nut 53 and receptacle 69 can therefore be eliminated. Thus, the present invention includes such variations as a snap cover assembly comprising anchor 66 and cover 76 which could be made integral thereto.

Furthermore, while aperture 54*b* into which anchor lug 67 is inserted is shown as being oval throughout from one side of the of rail to the other, it is within the scope of the present invention to have only that portion of aperture 54*b* that received anchor lug 67 have a non-circular configuration to prevent rotation thereof. In other words, it is within the scope of the present invention that aperture 54*b* have a first mating portion for receiving lug 61 of fastening plug 60 and a second mating portion for receiving anchor lug 67 of anchor 66. Thus, the first mating portion that receives lug 61 of fastening plug 60 could be circular rather than non-circular, thereby allowing rotation of plug 60, while the second mating portion and lug 67 would remain non-circular, thus preserving the non-rotational feature of anchor 66.

Additionally, while anchor rim 68 and snap cover 76 are illustrated as having a circular configuration, other curved configurations such as an oval or parallelogram configurations such as a square are also within the scope of the present invention.

Having thus described the present invention, other modifications, alterations or substitutions may now suggest themselves to those skilled in the art all of which are within the spirit and scope of the present invention. It is therefore intended that the present invention be limited only by the scope of the attached claims below.

What is claimed is:

1. A fastening system for attaching a wheel to an in-line roller skate, said in-line roller skate having a frame including first and second side rails each having a predetermined thickness t, said side rails being provided for mounting therebetween at least one wheel having a wheel axle bore and each said rail having an axle aperture, said first aperture having a substantially eccentric configuration, said fastening system comprising:

a wheel axle comprising a bolt having a shaft and having a bolt head at one end of said shaft configured to receive a fastening tool means and a threaded bolt end disposed at the other end of said shaft, said wheel axle being received within said wheel axle bore and rotatably mounting said wheel;

a fastening plug including a collar and a lug, said lug configured for mateable reception by said eccentric axle aperture in said first side rail, said lug being inserted into said eccentric axle aperture from a first direction, said collar extending radially outward from said lug to bear against said first side rail, said lug having a thickness $t_{lug}$ that is less than said thickness t, said plug including an axle bore configured to receive said wheel axle shaft; and a snap cover assembly, said assembly including:

a nut;

an anchor including an anchor rim and an anchor lug, said anchor lug configured for mateable reception by said eccentric axle aperture in said first side rail, said anchor lug being inserted into said aperture from a second direction opposite to said first direction, said anchor lug having a thickness $t_{anchor}$ that is less than said thickness t, said anchor rim defined in part by an inner surface for bearing against said first side rail, an outer surface of said anchor including a central receptacle configured to receive said nut and prevent rotation thereof, and at least one outer side surface extending between said inner surface and said outer surface, said anchor including an anchor axle bore coaxial with said central receptacle for receiving said axle; and a snap cover adapted to be yieldably snap fitted to said anchor rim to cover said nut when said nut is received in said central receptacle, said snap cover comprising a top portion and a peripheral snap cover rim integral with said top portion, said snap cover rim extending to overlie said anchor rim and having an internal snap fit groove defined therein for receiving and engaging said anchor rim.

2. The fastening system of claim 1 wherein said axle apertures each have a substantially oval configuration.

3. The fastening system of claim 2 wherein said anchor rim and said snap cover have a substantially circular configuration.

4. The fastening system of claim 1 wherein said anchor is made of a synthetic material and said anchor axle bore has a diameter less than the diameter of said threaded bolt end such that said threaded axle bolt end cuts threads into said anchor axle bore as said axle bolt is screwed into said anchor axle bore.

5. The fastening system of claim 4 wherein $t_{lug}+t_{anchor}\leqq t$.

6. The fastening system of claim 1 wherein $t_{lug}+t_{anchor}\leqq t$.

7. A method for assembling an in-line roller skate using a fastening system and a fastening tool means, wherein said roller skate includes:

a boot and a frame attached thereto, said frame including a first and a second side rail each having first and second sides and said rails mutually facing each other and defining respective inside rail surfaces therebetween, each said side rail having an axle aperture;

a wheel having a wheel axle bore;

a wheel axle comprising a bolt having a shaft and having a bolt head at one end of said shaft configured to receive the fastening tool means and a threaded bolt end disposed at the other end of said shaft, said wheel axle being received within said wheel axle bore and rotatably mounting said wheel;

a fastening plug including a collar and a lug, said lug configured for mateable reception by said first side rail axle aperture, said collar extending radially outward from said lug to bear against said first side rail, said plug including an axle bore configured to receive said wheel axle; and a snap cover assembly, said assembly including a threaded fastener to receive said threaded bolt end of said shaft;

an anchor including an anchor rim and an anchor lug, said anchor lug configured for mateable reception by said first side rail axle aperture, said anchor including a receptacle configured to receive said threaded fastener and retain said fastener in a non-rotational condition and further including an anchor axle bore for receiving said axle; and a snap cover adapted to be yieldably snap fitted to said anchor to cover said fastener;

said method comprising the steps of inserting said fastening plug into said first side rail axle aperture from said first side thereof such that said collar bears against said inside rail surface thereof;

inserting said anchor into said first side rail axle aperture from said second side of said first side rail;

inserting said fastener into said receptacle;

placing said wheel between said first and second side rails such that said axle apertures, said wheel axle bore, said plug axle bore, and said anchor axle bore are substantially aligned with each other;

inserting said axle through said second rail and along said aligned axle apertures and said wheel axle bore, said plug axle bore and said anchor axle bore;

threading said axle into said fastener using the fastening tool means; and attaching said snap cover to said anchor.

8. The method of claim 7 wherein said axle apertures each have a substantially oval configuration.

9. The method of claim 8 wherein said anchor rim and said snap cover have a substantially circular configuration.

10. The method of claim 7 wherein said anchor is made of a synthetic material and said anchor axle bore has a diameter less than the diameter of said threaded bolt end and wherein said threading step includes cutting threads into said anchor axle bore.

11. The method of claim 10 wherein:

said side rails each have a thickness t;

said lug of said fastening plug has a thickness $t_{lug}$; said anchor lug has a thickness $t_{anchor}$; and wherein $t_{lug}+t_{anchor}\leqq t$.

12. The method of claim 7 wherein:

said side rails have a thickness t;

said lug of said fastening plug has a thickness $t_{lug}$;

said anchor lug has a thickness $t_{anchor}$; and wherein $t_{lug}+t_{anchor}\leqq t$.

13. The method of claim 7 including inserting said nut into said receptacle and attaching said snap cover to said anchor before inserting said anchor into said first side rail axle aperture.

14. A fastening system for attaching a wheel to an in-line roller skate having a frame including first and second side rails, at least said first side rail having a predetermined thickness t, said side rails being provided for mounting therebetween at least one wheel having a wheel axle bore and each said side rail having an axle aperture, said first side rail aperture having a substantially eccentric configuration, said fastening system comprising:

a wheel axle comprising a bolt having a shaft and having a bolt head at one end of said shaft configured to receive a fastening tool means and a threaded bolt end disposed at the other end of said shaft, said wheel axle being received within said wheel axle bore and rotatably mounting said wheel;

a fastening plug including a collar and a lug, said lug configured for mateable reception by said eccentric axle aperture in said first side rail, said lug being inserted into said eccentric axle aperture from a first direction, said collar extending radially outward from said lug to bear against said first side rail, said lug having a thickness $t_{lug}$ that is less than said thickness t, said plug including an axle bore configured to receive said wheel axle; and a snap cover assembly, said assembly including an anchor including an anchor rim and an anchor lug, said anchor lug configured for mateable reception by said eccentric axle aperture in said first side rail, said anchor lug being inserted into said eccentric axle aperture from a second direction opposite to said first direction, said anchor lug having a thickness $t_{Anchor}$ that is less than said thickness t, said anchor rim defined in part by an inner surface for bearing against said first side rail, an outer surface, and at least one outer side surface extending between said inner surface and said outer surface, said anchor including an anchor axle bore coaxial with said axle bore for receiving said axle; and a snap cover adapted to be yieldably snap fitted to said anchor, said snap cover comprising a top portion and a peripheral snap cover rim integral with said top portion, said snap cover including means for attaching said snap cover to said anchor.

15. The fastening system of claim 14 wherein said axle apertures each have a substantially oval configuration.

16. The fastening system of claim 15 wherein said anchor rim and said snap cover have a substantially circular configuration.

17. The fastening system of claim 14 wherein said anchor is made of a synthetic material and said anchor axle bore has a diameter less than the diameter of said threaded bolt end such that said threaded bolt end cuts threads into said anchor axle bore as said bolt is screwed into said anchor bore.

18. The fastening system of claim 17 wherein $t_{lug}+t_{anchor}\leqq t$.

19. The fastening system of claim 14 wherein $t_{lug}+t_{anchor}\leqq t$.

20. A fastening system for attaching a wheel to an in-line roller skate, and in-line roller skate having a frame including first and second side rails each having a predetermined thickness t, said side rails being provided for mounting therebetween at least one wheel having a wheel axle bore and each side rail including an axle aperture, said axle aperture of said first side rail including a first mating portion and a second mating portion, said fastening system comprising:

a wheel axle comprising a bolt having a shaft and having a bolt head at one end of said shaft configured to receive a fastening tool means and a threaded bolt end disposed at the other end of said shaft, said wheel axle being received within said wheel axle bore and rotatably mounting said wheel;

a fastening plug including a collar and a lug, said lug configured for mateable reception by said first mating portion of said first side rail axle aperture, said lug being inserted into said axle aperture first mating portion form a first direction, said collar extending radially outward from said lug to bear against said first side rail, said lug having a thickness $t_{lug}$ that is less than said thickness t, said plug including an axle bore configured to receive said wheel axle; and a snap cover assembly, said assembly including:

a nut;

an anchor including an anchor rim and an anchor lug, said anchor lug configured for mateable reception by said second mating portion of said first side rail axle aperture, said anchor lug being inserted into said second mating portion from a second direction opposite to said first direction, said second mating portion and said anchor lug having a non-circular configuration to prevent rotation of said anchor with respect to said axle aperture, said anchor lug having a thickness $t_{anchor}$ that is less than said thickness t, said anchor rim define din part by an inner surface for beating against said first side rail, an outer surface including a receptacle configured to receive said nut and prevent rotation thereof, and at least one outer side surface extending between said inner surface and said outer surface, said anchor including an anchor axle bore coaxial with said receptacle for receiving said axle; and a snap cove adapted to be yieldably snap fitted to said anchor to cover said nut when said nut is received within said receptacle, said snap cover comprising a top portion and a peripheral snap cover rim integral with said top portion, said snap cover rim having an internal snap fit groove defined therein for receiving said anchor rim.

21. The fastening system of claim 20 wherein said second mating portion and said anchor lug each as an oval configuration.

22. The fastening system of claim 20 wherein said anchor rim and said snap cover have a substantially circular configuration.

23. The fastening system of claim 20 wherein said anchor is made of a synthetic material and said anchor axle bore has a diameter less than the diameter of said threaded bolt end such that said threaded axle bolt end cuts threads into said anchor axle bore as said axle bolt is screwed into said anchor bore.

24. The fastening system of claim 20 wherein $t_{lug}+t_{anchor}\leqq t$.

25. The fastening system of claim 20 wherein $t_{lug}+t_{anchor}\leqq t$.

26. A fastening system for attaching a wheel to an in-line roller skate, said in-line roller skate having a frame including first and second side rails, said first side rail having a predetermined thickness t, said side rails being provided for mounting therebetween at least one wheel having a wheel axle bore and each said rial having an axle aperture, said first side rail axle aperture having a substantially eccentric configuration, said fastening system comprising:

a wheel axle comprising a bolt having a shaft and having a bolt head at one end of said shaft configured to receive a fastening tool means and a threaded bolt end disposed at the other end of said shaft, said wheel axle being received within said wheel axle bore and rotatably mounting said wheel;

a snap cover assembly, said assembly including:

an anchor including means for receiving and retaining said threaded bolt end, an anchor rim, and an anchor lug, said anchor lug configured for mateable reception by said axle aperture in said first side rail, said anchor lug being inserted into said axle aperture from a first direction, said anchor lug having a thickness $t_{anchor}$ that is less than said thickness t, said anchor rim defined in part by an inner surface for bearing against said side rail, an outer surface, and at least one outer side surface extending therebetween; and a snap cover adapted to be yieldably snap fitted to said anchor, said snap cover comprising a top portion and a peripheral snap cover rim integral with said top portion, said snap cover including means for attaching said snap cover to said anchor.

27. The fastening system of claim 26 wherein said first side rail axle aperture has a substantially oval configuration.

28. The fastening system of claim 27 wherein said anchor rim and said snap cover each have a substantially circular configuration.

29. The fastening system of claim 26 wherein said anchor is made of a synthetic material and said anchor axle bore has a diameter less than the diameter of said threaded bolt end such that said threaded bolt end cuts threads into said anchor axle bore as said bolt is screwed into said anchor axle bore.

30. A fastening system for attaching a wheel to an in-line roller skate, said in-line roller skate having a frame including first and second side rails, each side rail having an axle aperture, said side rails being provided for mounting therebetween at least one wheel having a wheel axle bore, said fastening system comprising:

a wheel axle comprising a bolt having a shaft and having a bolt head at one end of said shaft configured to receive a fastening tool means, and a threaded bolt end disposed at the other end of said shaft;

a cover assembly, said assembly including:

an anchor having an inner surface for bearing against said first side rail, said anchor further including means for receiving and retaining said wheel axle; and means for preventing rotation of said cover assembly relative to said first side rail, wherein said means for preventing rotation includes:

an anchor lug integral with said anchor, said anchor lug configured for mateable reception by said first side rail axle aperture, said anchor lug being inserted into said axle aperture of said first side rail from a first direction, said first side rail having a thickness t and said anchor lug having a thickness $t_{anchor}$ that is less than said thickness t, wherein said anchor lug and said first side rail axle aperture have non-circular configurations;

whereby said axle aperture and said anchor lug cooperate with each other to prevent rotation of said cover assembly and said wheel is attached to said skate by inserting said wheel axle through said axle aperture of said first side rail, through said wheel axle bore, and through said axle aperture of said second side rail, and them by attaching said threaded bolt end of said bolt to said anchor such that said threaded bolt end is received and retained by

31. A fastening system for attaching a wheel to an in-line roller skate, said in-line roller skate having a frame including first and second side rails, each side rail having an axle aperture, said side rails being provided for mounting therebetween at least one wheel having a wheel axle bore, said fastening system comprising;

a wheel axle comprising a bolt having a shaft and having a bolt head at one end of said shaft configured to receive a fastening tool means, and a threaded bolt end disposed at the other end of said shaft;

a cover assembly, said assembly including: an anchor having an inner surface for bearing against said first side rail, said anchor further including means for receiving and retaining said wheel axle; and means for preventing rotation of said cover assembly relative to said first side rail, wherein said means for receiving and retaining said axle comprises:

said anchor being made of a synthetic material and having an anchor axle bore having a diameter less than the diameter of said threaded bolt end such that said threaded axle bolt end cuts threads into said anchor axle bore as said wheel axle bolt is screwed into said anchor axle bore;

whereby said wheel is attached to said skate by inserting said wheel axle through said axle aperture of said first side rail, through said wheel axle bore, and through said axle aperture of said second side rail, and then by attaching said threaded bolt end of said bolt to said anchor such that said threaded bolt end is received and retained by said anchor and said wheel axle is received within said wheel axle bore and rotatably mounts said wheel.

32. The fastening system of claim 31 wherein said first side rail has a predetermined thickness t, and further including:

a fastening plug including a collar and a lug, said lug configured for mateable reception by said axle aperture in said first side rail, said lug being inserted into said aperture from a second direction opposite said first direction, said collar extending radially outward from said lug to bear against said side rail, said lug having a thickness $t_{lug}$ that is less than said thickness t, and including an axle bore configured to receive said wheel axle.

33. The fastening system of claim 32 wherein said anchor includes an anchor lug having a thickness $t_{anchor}$ and $t_{lug}+t_{anchor}\leqq t$.

34. A method for assembling an in-line roller skate using a fastening system and a fastening tool means;

said in-line roller skate comprising a boot and a frame attached thereto, said frame including first and second side rails for mounting a wheel therebetween, said wheel having a wheel axle bore, each said side rail having first and second sides, said rails mutually facing each other and defining respective inside rail surface therebetween, and each said side rail having an axle aperture;

said fastening system comprising;

a wheel axle comprising a bolt having a shaft and having a bolt head at one end of said shaft configured to receive the fastening tool means, and a threaded bolt end disposed at the other end of said shaft;

a fastening plug including a collar and a lug, said lug configured for mateable reception by said first side rail axle aperture, said collar extending radially outward from said lug to bear against said first side rail, said plug including an axle bore configured to receive said wheel axle;

a cover assembly, said assembly including an anchor having an inner surface for bearing against said first side rail and means for receiving and retaining said axle; and means for preventing rotation of said cover assembly relative to said side rails;

wherein said means for preventing rotation includes:

an anchor lug integral with said anchor, said anchor lug configured for mateable reception by and inserted into said axle aperture of said first side rail from a first direction, said first side rail having a thickness t, and said anchor lug having a thickness $t_{anchor}$ that is less than said thickness t, said anchor lug and said first side rail axle aperture having non-circular configurations, said axle aperture and said anchor lug cooperating with each other to prevent rotation of said cover assembly;

said method comprising the steps of:

inserting said fastening plug into said first side rail axle aperture from said first side thereof such that said collar bears against said inside rail surface thereof;

inserting said anchor lug into said first side rail axle aperture from said second side of said first side rail;

placing said wheel between said first and second side rails such that said axle apertures, said wheel axle bore, and said plug axle bore are aligned with each other;

inserting said axle through said second side rail and along said aligned axle apertures, said wheel axle bore, and said plug axle bore; and attaching said threaded end of said wheel axle to said anchor by turning said axle with said fastening tool means such that said receiving and retaining means engages said threaded end.

35. The method of claim 34 wherein said means for receiving and retaining said axle comprises:

said anchor being made of a synthetic material and having an anchor axle bore having a diameter less than the diameter of said threaded bolt end, wherein said method includes the step of cut threads into said anchor axle bore with said threaded bolt end as said wheel axle threaded bolt is screwed into said anchor axle bore.

36. The method of claim 35 wherein said lug is said fastening plug has a thickness $t_{lug}$ that is less than said thickness t.

37. The method of claim 36 wherein $t_{lug} + t_{anchor} \leqq t$.

* * * * *